United States Patent [19]

King

[11] Patent Number: 4,771,992

[45] Date of Patent: Sep. 20, 1988

[54] MULTI-HOLE INJECTION VALVE

[75] Inventor: Patrick D. King, Rantoul, Ill.

[73] Assignee: Flo-Con Systems, Inc., Champaign, Ill.

[21] Appl. No.: 53,080

[22] Filed: May 22, 1987

Related U.S. Application Data

[63] Continuation-in-part of Ser. No. 14,999, Feb. 17, 1987, which is a continuation-in-part of Ser. No. 885,873, Jul. 15, 1986.

[51] Int. Cl.[4] ..... C21C 5/48

[52] U.S. Cl. ..... 266/265; 266/224; 266/268

[58] Field of Search ..... 266/47, 220, 224, 265, 266/268, 287

[56] References Cited

U.S. PATENT DOCUMENTS

| | | | |
|---|---|---|---|
| 4,219,188 | 8/1980 | Meier | 266/220 |
| 4,222,553 | 9/1980 | Edamoto | 266/47 |
| 4,575,393 | 3/1986 | Bates et al. | 266/225 |
| 4,583,721 | 4/1986 | Arakawa et al. | 266/220 |
| 4,708,327 | 11/1987 | Waltenspühl | 266/220 |

FOREIGN PATENT DOCUMENTS

| | | | |
|---|---|---|---|
| 13015 | 1/1985 | Japan | 266/218 |

*Primary Examiner*—L. Dewayne Rutledge
*Assistant Examiner*—Robert L. McDowell
*Attorney, Agent, or Firm*—Jack E. Dominik

[57] ABSTRACT

A multiple orifice injection valve having a stationary block which communicates between the vessel and a sliding plate. The sliding plate is provided with at least one injection port and drive means for rotatably indexing the same in and out of register with the various orifices in the stationary block. Both the stationary block and sliding plate may have special wear features. The sliding plate is held by means of a carrier, and the same urged by a plurality of spring-loaded rockers into pressure face-to-face relationship with the stationary block. The valve can be open by a toggle latch and toggle hinge assembly thereby permitting removal of the sliding plate and/or the stationary block. Injection is provided by a quick disconnect coupling having two injection ports. The one port receives wire or other metallic material in wire form, and the second port injects gas, powdered metals, or other fluid-like materials. The method contemplates the steps of providing a multiple orifice connection between the inside of the vessel and a shut-off plate, with the shut-off plate having a single orifice or more orifices for indexing in and out of position with the orifices in the stationary block. Also blocking plugs are provided in the stationary block which, according to the method, are forceably removed prior to the ladle metallurgical treatment applied.

5 Claims, 5 Drawing Sheets

MULTI-HOLE INJECTION VALVE

CROSS-REFERENCE TO RELATED APPLICATIONS

This application is a continuation-in-part of application Ser. No. 014,999 filed Feb. 17, 1987 by the same inventor herein and entitled "INJECTION VALVE COMPONENTS AND METHOD", which application in turn is a continuation-in-part of application Ser. No. 885,873 filed July 15, 1986 by the same inventor herein and entitled "INJECTION VALVE COMPONENTS AND METHOD", both still pending.

BACKGROUND OF THE INVENTION

1. Field of the Invention

The present invention relates primarily to ladle metallurgy, and more specifically to an injection valve for use with a ladle, and the method of ladle metallurgy.

2. Summary of the Prior Art

The prior art is exemplified in U.S. Pat. Nos. 3,997,148; 4,298,192; 4,423,858; and 4,582,232. Various devices have been developed for injection into ladles, tundishes, or other holding vessels. Several are complex in nature, and most, because of a single injection capability, must be lanced or otherwise replaced after each injection.

SUMMARY OF THE INVENTION

The present invention is directed to a multiple orifice injection valve having a stationary block which communicates between the vessel and a sliding plate. The sliding plate is provided with at least one injection port and drive means for rotatably indexing the same in and out of register with the various orifices in the stationary block. Both the stationary block and sliding plate may have special wear features. The sliding plate is held by means of a carrier, and the same urged by a plurality of spring-loaded rockers into pressure face-to-face relationship with the stationary block. The valve can be open by a toggle latch and toggle hinge assembly thereby permiting removal of the sliding plate and/or the stationary block. Injection is provided by a quick disconnect coupling having two injection ports. The one port receives wire or other metallic material in wire form, and the second port injects gas, powdered metals, or other fluid-like materials. The method contemplates the steps of providing a multiple orifice connection between the inside of the vessel and a shut-off plate, with the shut-off plate having a single orifice or more orifices for indexing in and out of position with the orifices in the stationary block. Also blocking plugs are provided in the stationary block which, according to the method, are forceably removed prior to the ladle metallurgical treatment applied.

In view of the foregoing it is a principal object of the present invention to provide a multiple orifice injection valve which permits injecting at various times during a heat, and shutting off the injection, and reactivating again for six total applications.

Another object of the present invention is to provide an injection valve which permits the simultaneous ladle treatment with a wire-type metal alloy, and also the injection of gas or powdered materials.

Still another object of the present invention is to provide a multiple orifice injection valve in which the two principal members, the stationary block and the slide gate, may be readily removed and replaced.

A more detailed object of the present invention is to provide an injection valve with a stationary block and sliding plate, one or both of which are elliptical in cross-section thereby permitting locking to related structures.

Yet another object of the present invention is to provide the stationary block with a wear plate and the sliding plate with a wear plug to upgrade the usage and life of the block plate sets.

BRIEF DESCRIPTION OF THE DRAWINGS

Further objects and advantages of the present invention will become apparent as the following description proceeds, taken in conjunction with the accompanying drawings, in which.

DETAILED DESCRIPTION OF A PREFERRED EMBODIMENT

Figures 1, 2:
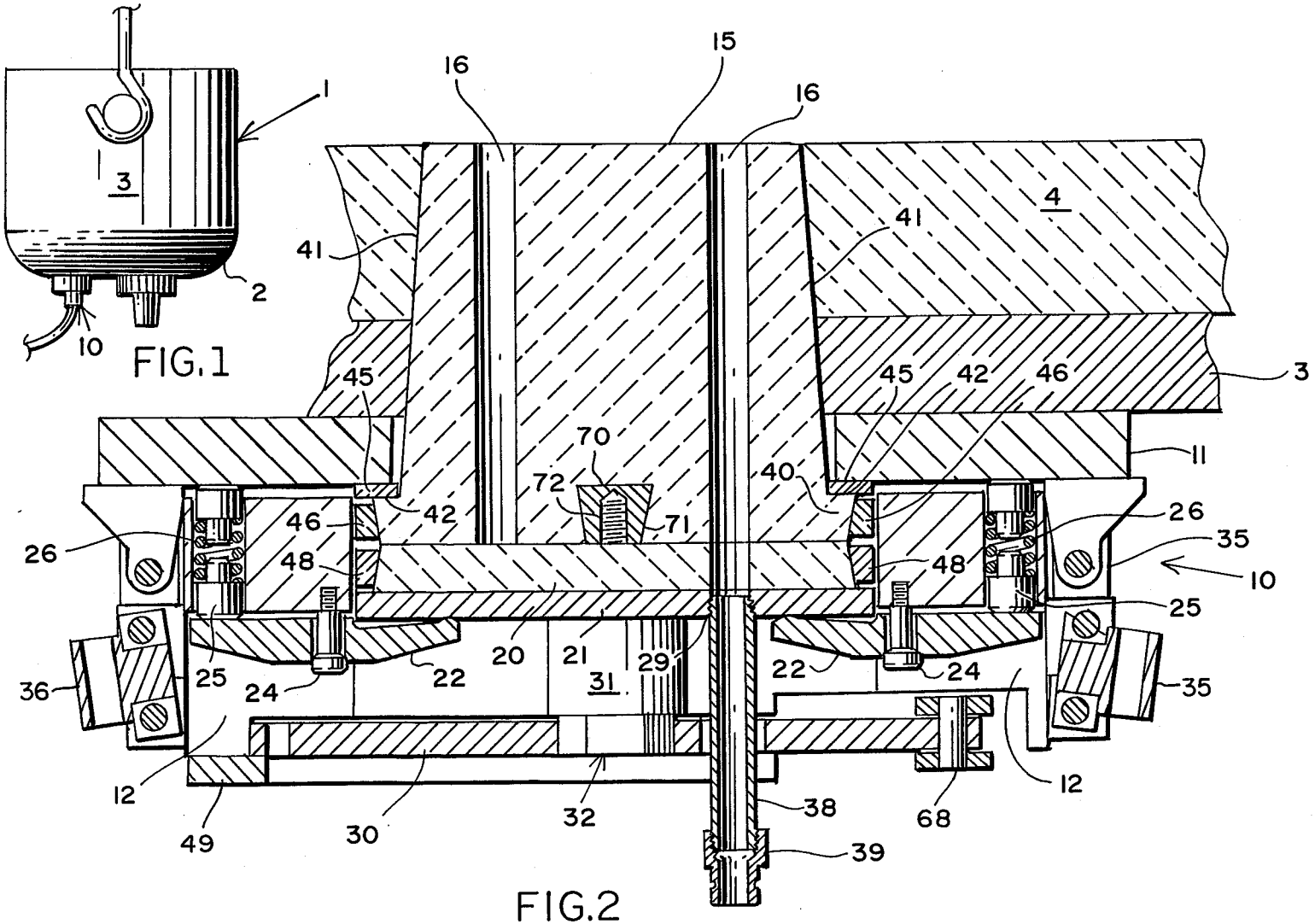
FIG. 1 is a partially diagrammatic view of a ladle or vessel showing a sliding gate valve at its lower portion and the ulitilization of an injection valve also adjacent the slide gate on the lower portion.
FIG. 2 is an enlarged transverse sectional view of the injection valve showing its mounted relationship with the ladle or vessel.
Figure 4:
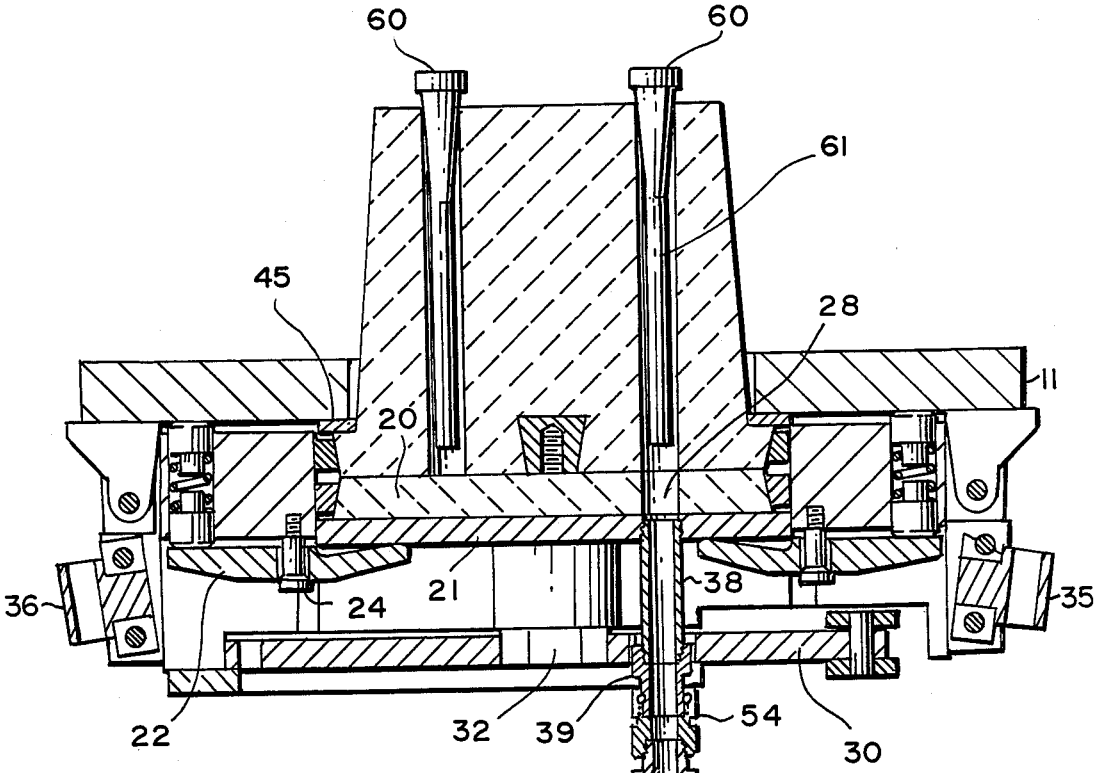
FIG. 4 is a further sectional view in enlarged form of the multiple media injection assembly.
Figure 4:
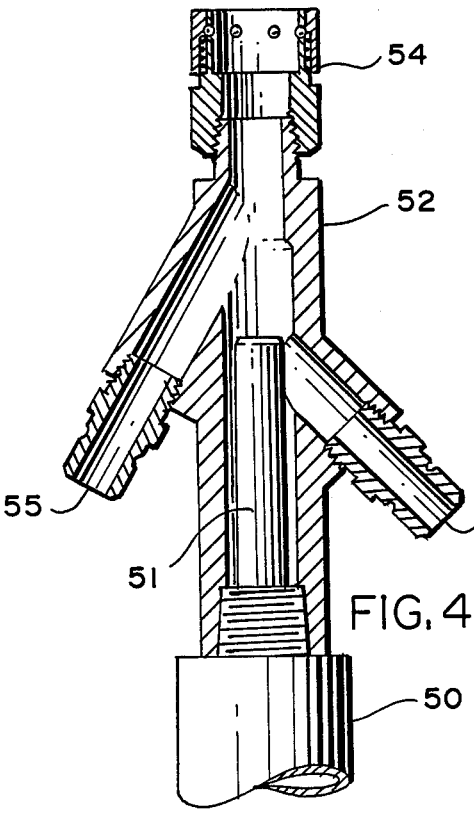

Referring now to the drawings, FIG. 1 illustrates the utilization of a ladle 1 having a typical slide gate 2 mounted at its lower portion. an injection valve 10 is illustrated diagrammatically at a lower portion of the ladle 1. Here it should be understood that an injection valve 10 may also be applied to a tundish, or other vessel for the holding of metals in anticipation of teeming, and after being withdrawn from the furnace. Most such vessels are provided with independent heating elements in order to maintain the contained metal in a molten condition.

As shown in FIG. 2, the injection valve 10 is mounted to the vessel or ladle 1 by being secured to the ladle wall 3, and penetrating the ladle refractory liner 4 through an opening 5. A mounting plate 11 is provided at the upper portion of the injection valve 10 to be bolted or otherwise secured to the ladle wall 3. A main frame 12 extends downwardly from the mounting plate 11 and holds the various elements in the injection valve 10.

Figure 9:
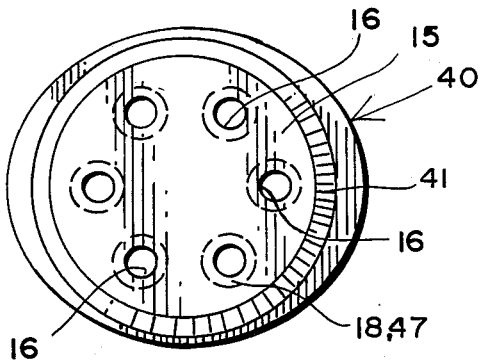
FIG. 9 is a top view of the stationary block illustrating the orientation of the orifices, and the nature of the elliptical construction.
Figure 10:
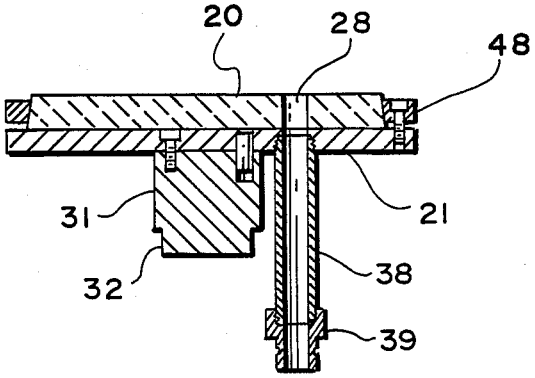
FIG. 10 is an enlarged view of the drive hub which, in its assembled relationship, connects the drive plate operatively with the sliding plate carrier.

Central to the construction of the injection valve is the stationary block 15 which is positioned within the opening 5. The face of the stationary injection block 15 may be elliptical in horizontal cross-section to secure the same against rotation inside the opening 5. To this end the opening 5 is complementarily elliptical to receive and lockingly engage the stationary block 15. Central of the stationary block are a plurality of stationary block orifices 16. As shown in FIG. 9, these orifices 16 are essentially oriented on a circle surrounding the geometrical center of the stationary block 15.

Also central to the injection valve is a rotating injection slide plate 20 mounted on top of a slide plate carrier 21. The rotating slide plate 20 is preferably elliptical in configuration with means for mounting the same to the slide plate carrier 21 which will be described hereinafter.

Figure 7:
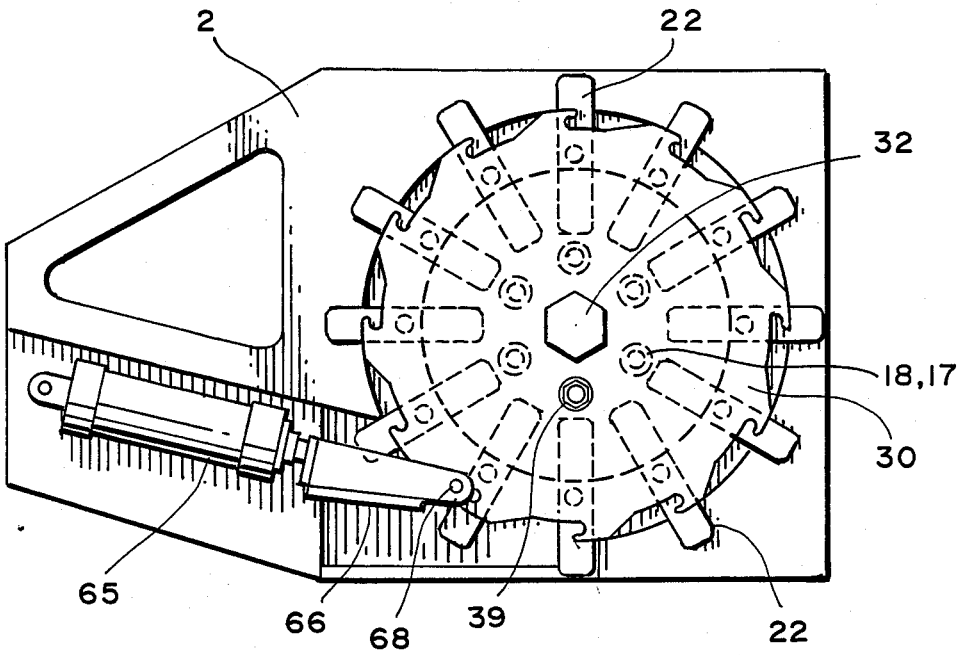
FIG. 7 is a bottom view of the injection valve showing in phantom lines the location of the rocker assemblies which hold the sliding plate in pressure relationship with the stationary block.

In order to maintain the rotary slide plate in pressure face-to-face relationship with the lower end portion of the stationary block 15, a plurality of rocker arms 22 are provided to yieldably engage the slide plate carrier 21. The rocker arms 22, particularly as shown in phantom lines in FIG. 7, are oriented radially around the slide plate carrier 21. Again as shown in FIG. 2, each rocker arm 20 is pivotally secured by a rocker arm bolt 24. One end of the rocker arm is engaged by a spring pad 25 which, in turn, is urged downwardly by spring 26 to thereby pivot the rocker arm 22 and urge its opposite end to press against the slide plate carrier 21.

The slide injection plate 20 is provided desirably with at least one orifice 28. A carrier pipe connector 29 is secured to the slide plate carrier 21 in an orifice designed for orientation immediately beneath the slide plate orifice 28. Additional orifices 28 and inlet plates 29 may be mounted on the sliding injection plate 20.

The entire mechanism is driven by a drive plate 30, which coacts through a drive hub 31 having a hex head 32 secured in the drive plate 30. The hub 31 connects directly to the lower portion of the slide plate carrier 21 and is secured in driving engagement therewith by pin 33 and bolt 34.

The main frame 12 of the injection valve 10 has a latch toggle 35, and an opposed hinge toggle 36. By releasing the latch toggle and hinging the frame the interior can be opened up for servicing the stationary block 15, the rotary slide plate 20, and other elements of the construction.

Figure 3:
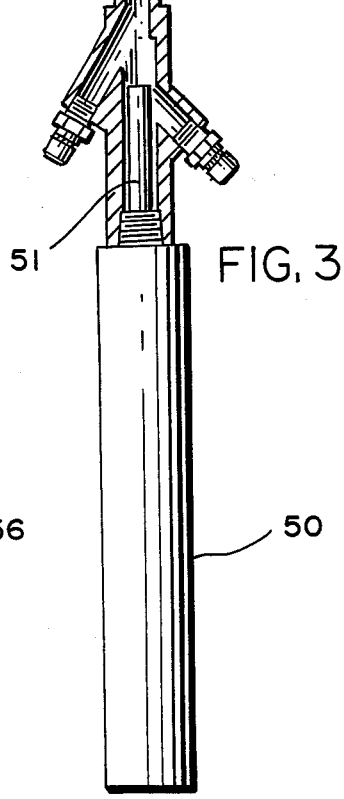
FIG. 3 is a somewhat smaller view of what is shown in FIG. 2, but showing in extended form the punch-out cylinder and multiple media injection connector.

Turning now to FIG. 3, it will be seen in greater detail that the inlet pipe 38 which connects between the drive plate 30 and the slide plate carrier 21 includes an inlet coupling 39.

Figure 8:
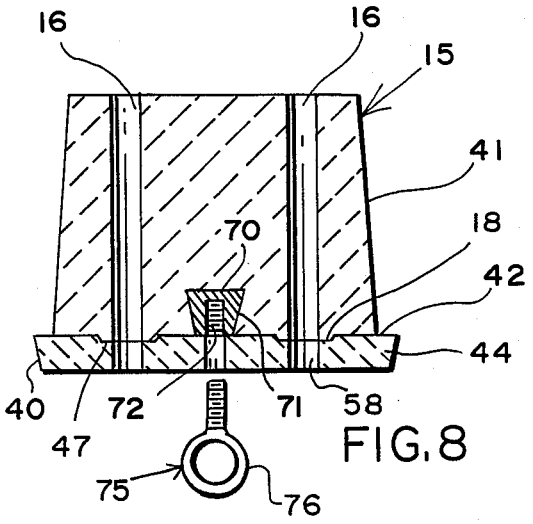
FIG. 8 is an enlarged transverse sectional view of the stationary block and showing an optional wear plate and the puller assembly.

As noted in FIG. 8, the stationary injection block 15 includes a stationary injection block collar 40 which is preferably elliptical, a stationary injection block sidewall 41, which is frustoconical, and a stationary injection block collar shoulder 42. The stationary block shoulder 42 is engaged, as shown in FIG. 2, by a backing ring 45. A clamping ring 46 is provided for the stationary block collar 40, and is elliptical and complementary to the elliptical stationary injection block collar 40. It thereby permits securing the stationary injection block 15 against the backing ring 45 which, in turn, engages the mounting plate 11. A similar clamp ring 48 is provided for the rotary sliding plate 20. It is also similarly secured to the rotary slide plate carrier 21. The drive plate retainer 49 as shown in FIG. 2 secures the drive plate to the frame 11.

Noting now in FIG. 3, when it is time to begin ladle metallurgy, the punch-out cylinder 50 is activated and its punch-out rod 51 extends upwardly through the multi-media connector body 52. The multi-media connector body 52 has a multi-media connection 54, and a wire port 55. The wire port 55 is upstream from the multi-media port 56 so that any wire injected is unrestricted and uninhibited by the interior elements contained in the multi-media connector body 52. Such multi-media may include substances fed or suspended by fluids, such as gas or liquies. The purpose of the punch-out rod 51 is to engage the orifice plug 60 and more particularly its orifice plug shaft 61 to open the communication between the injection and the interior portion of the ladle 1.

Figure 5:
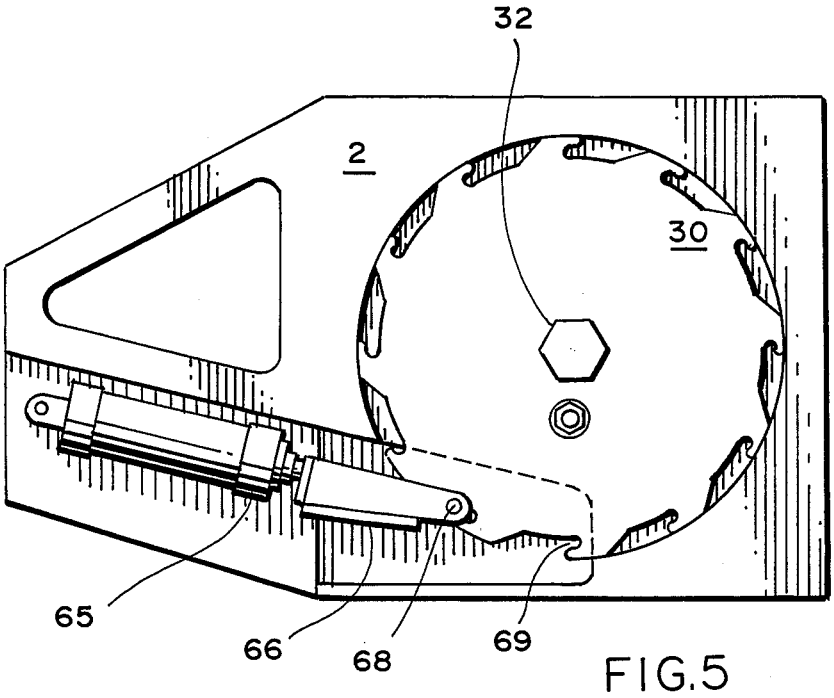
FIG. 5 is a bottom view of the injection valve showing the drive cylinder for indexing in its retraced position.
Figure 6:
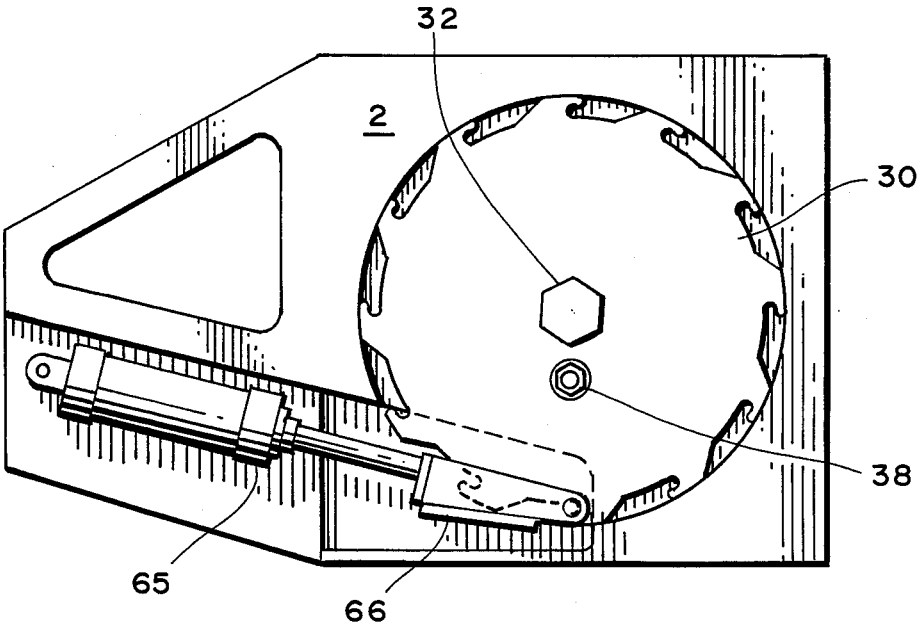
FIG. 6 is a sequential view of that shown in FIG. 5 with the drive cylinder in its extended position, having indexed from the configuration shown in FIG. 5.

Shown now in FIGS. 5 and 6 are the specifics of the drive plate 30. There it will be seen that a drive cylinder 65 operates a drive clevis 66. The drive clevis 66, in turn, contains the drive pin 68 which engages the drive notch 69 of the drive plate 30. Engagement is in indexing form, and the notches 69 are twice the number of orifices 16 in the stationary block 15. This permits each index to either shut off the orifice, or to align the orifices for injection.

After injection has been completed and the assembly is opened, the stationary block 15 can be removed by engaging its puller 70 shown in the lower portion of FIG. 8, and also in the lower central portion of FIG. 2. The puller 70 has a tapered frustoconical wall 71 which jammingly embeds the same at the central portion of the stationary injection block 15. Central to the puller 70 is a puller threaded bore 72. This is engaged by a threaded puller 75 having an eye or hook 76 as shown in exploded relationship to FIG. 8. This permits pulling the stationary block 15 out of the ladle opening 5 for replacement, or otherwise servicing the same.

To be noted in FIG. 8 is the combination with the stationary injection block 15 of an optional wear plate 44. The wear plate 44 is provided with recesses 47. The wear plate recesses 47 which surround each of the wear plate orifices 58. Oppositely stationary injection block bosses 18 are positioned at the interface betwen the stationary block and the wear plate 44 in surrounding relationship to the stationary block orifices 16. In this fashion, once the stationary block 15 is inserted in position, the elliptical wear plate is locked normally with the clamp ring 46. The offsetting locking relationship between the opposed block orifice bosses and wear plate orifice recesses insure a non-rotatable relationship between the block 15 and the wear plate 44.

Figure 11:
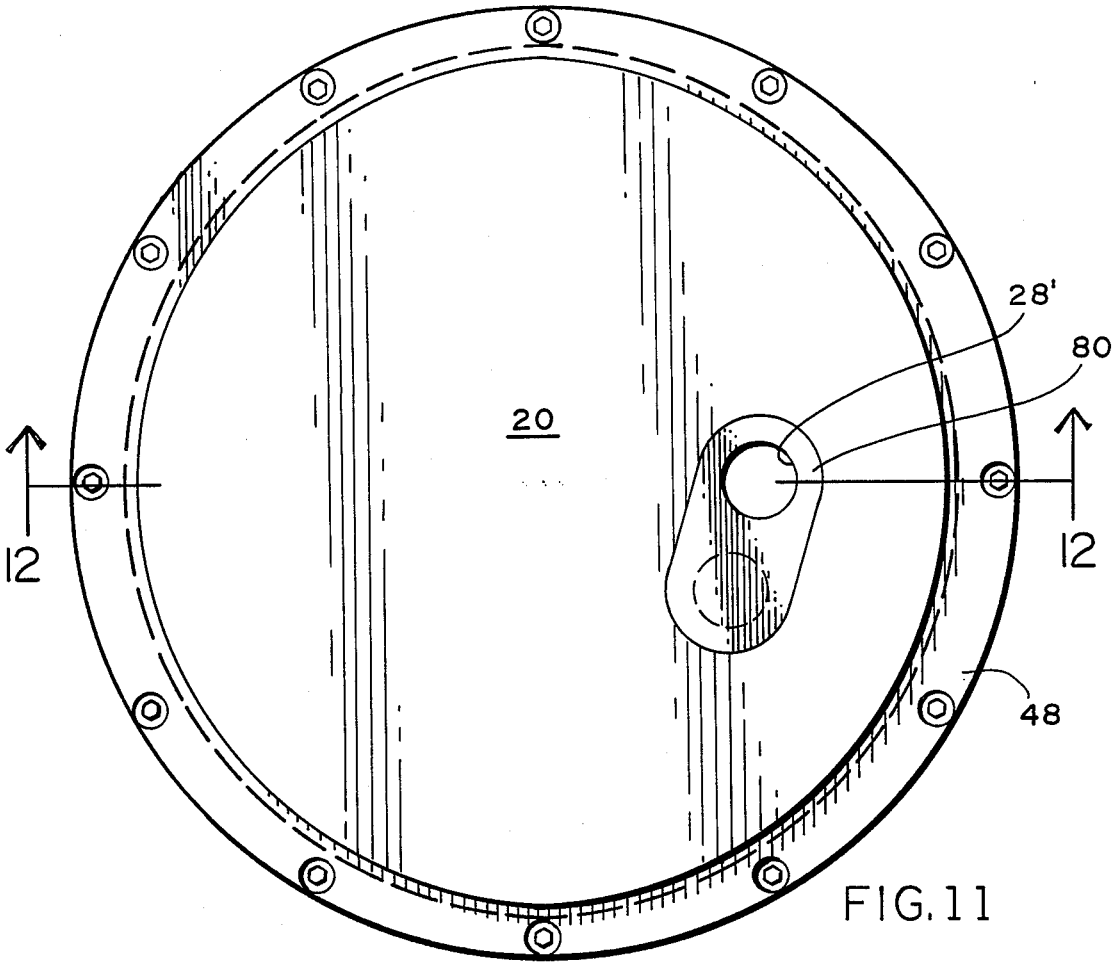
FIG. 11 is a plan view of an alternative embodiment sliding plate having a wear insert.

As shown in FIG. 11, the rotating injection plate 20 is optionally supplied with a release insert 80 inserted in a complimentary recess inside the plate 20. The orifice 28' is identical with the orifice where an insert 80 is not employed. Critical to the configuration of the insert 80, however, is its somewhat round configuration with the end opposed to the orifice 28' being positioned such a distance on the plate 20 that it will overlap an adjacent stationary block orifice 16.

Figure 12:
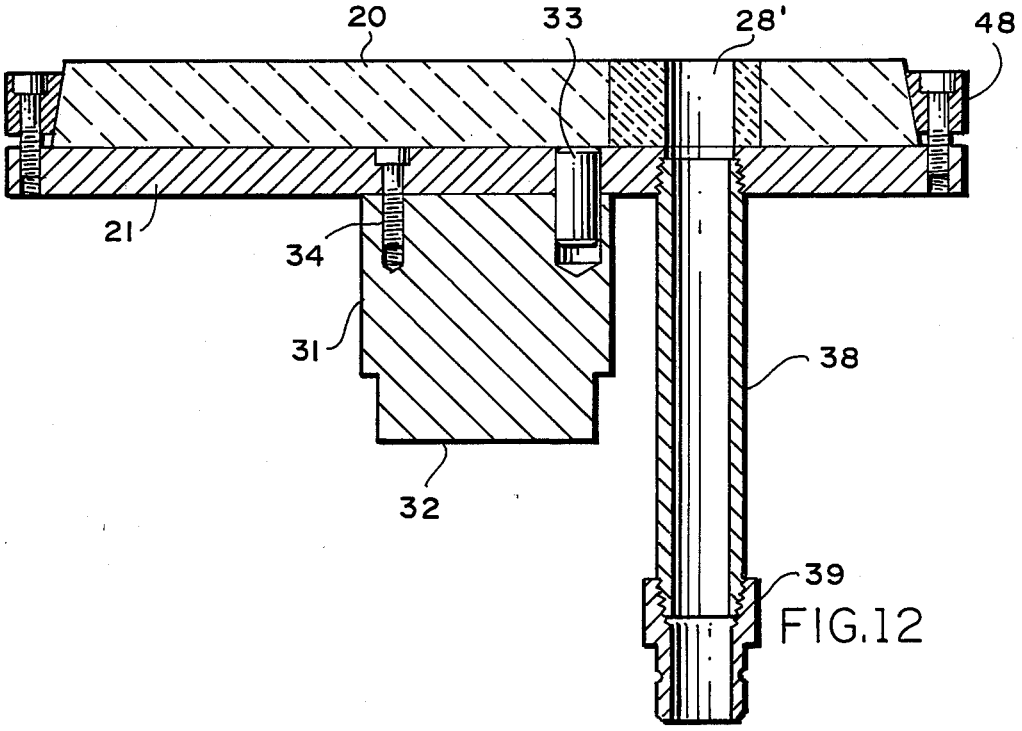
FIG. 12 is a transverse sectional view taken along section line 12—12 of FIG. 11.

In FIG. 12 the relationship between the rotating injection slide plate 20 and its slide plate carrier 21 is clearly shown. Also it will be noted that the drive hub 31 is secured to the slide plate carrier 21 by means of a pin 33, and secured against rotation by the bolt 34.

While materials do not necessarily form a limitation of the present invention, the release insert 80 employed in the rotating injection slide plate 20 should be of such a material as to form a smooth low permeability shut-off surface for metal to freeze in the bores of the stationary injection block. Once the metal freezes against the smooth low permeability surface, it does not have a tendency to attack the rest of the plate since the end of the frozen-off metal which may remain in the stationary block orifice 16 will be flushed off and flush with the balance of the refractory material in the rotating injection slide plate 20.

The method of the present invention contemplates metallurgy by steps taken in metal refining vessels. The fist step is to connect a gas or powdered injection member along with a wire injection member so that additives can be introduced at the same time gas is employed, stir the bath, assist in metallurgy, and to prevent a reverse flow of the metal. When shifting from one additive to another, the method contemplates a plurality of injection communications between the interior of the vessel and the injection apparatus. This permits sequential or simultaneous adding of various types of fluids, powders, and metals. Indeed, the same metal and gas can be added after a time delay by indexing to the next injection position. Sometimes staggered injection proves highly desirable and permits a greater homogeneity of the metallurgically treated contents of the vessel. It is important that indexing accomplish complete shut off in one position, and open communication in another position. Because a plurality of injection ports connect the vessel with the injection apparatus, lancing is not necessarily required after an orifice is frozen off with contained metal. Nonetheless provision may be made in order to lance an empty vessel by providing a second orifice in the sliding plate carrier with a lancing head.

Although particular embodiments of the invention have been shown and described in full here, there is no intention to thereby limit the invention to the details of such embodiments. On the contrary, the invention is to cover all modifications, alternatives, embodiments, usages and equivalents as fall within the spirit and scope of the present invention, specification, and appended claims.

What is claimed is:

1. A multi-hole injection valve comprising, in combination, a stationary injection block proportioned to fit within an opening in a vessel in open communication with the contents of the vessel, said block having an inner end and an outer end, a plurality of orifices radially spaced in said injection block and communicating from the inner end to the outer end, a sliding plate having at least one injection orifice, a carrier for the sliding plate, means for securing the stationary injection block against rotation, means for securing the sliding injection plate against rotation to the carrier, yieldable means urging the sliding injection plate into pressure face-to-face relationship with the stationary block, indexing means engaging the sliding injection plate to rotate the sliding injection plate orifice into and out of register with the stationary injection block orifices, and injection means secured to the sliding plate orifice for injection of additives through the slide plate and stationary block orifices when they are in alignment.

2. In the valve of claim 1, said indexing means comprising a drive plate coupled to the sliding plate, said drive plate having a plurality of peripherally spaced notches, and a power drive having a notch engaging end for selectively engaging the notches and drivingly indexing the sliding plate.

3. In the valve of claim 1, said stationary injection block having, at at least one portion thereof, an elliptical cross-section transverse to the orifices proportioned to lockingly fit in a corresponding elliptical opening in the wall of a vessel.

4. In the valve of claim 1, said sliding plate having an elliptical periphery and opposed faces, one face engaging the stationary block and one face engaging the sliding plate carrier, said periphery tapering in enlarging fashion in the direction of the carrier, a clamping ring having an interior proportioned to clampingly mate with the sliding plate periphery, and means for securing the ring to the carrier.

5. In the valve of claim 1, a frame shaped to surround the sliding plate a plurality of radially spaced rocker clamps having a clamping end and engaging end beneath the frame, a plurality of yieldable members in the frame bearing against the engagement ends of the rocker clamps urging the clamp ends into yieldable engagement with the sliding plate carrier, and means pivotally and removably securably mounting the frame to the valve, whereby the valve may be opened to service the plates.

* * * * *